United States Patent [19]

Harris

[11] 4,221,012

[45] Sep. 9, 1980

[54] BUNK BED SIDE RAIL HINGE LOCK

[75] Inventor: George M. Harris, Chicago, Ill.

[73] Assignee: Harris-Hub Co., Inc., Harvey, Ill.

[21] Appl. No.: 957,694

[22] Filed: Nov. 6, 1978

[51] Int. Cl.[2] ..... A47C 21/00

[52] U.S. Cl. ..... 5/430; 5/425; 5/8

[58] Field of Search ..... 248/72, 214, 222.2, 248/228; 5/8, 9, 200, 202, 430; 297/417; 312/258

[56] References Cited

U.S. PATENT DOCUMENTS

| | | | |
|---|---|---|---|
| 2,675,201 | 4/1954 | Friel | 248/72 |
| 2,703,265 | 3/1955 | Wolfe | 248/228 |
| 3,316,564 | 5/1967 | Rogers, Jr. | 5/9 R |

*Primary Examiner*—Casmir A. Nunberg

*Attorney, Agent, or Firm*—Dressler, Goldsmith, Shore, Sutker & Milnamow, Ltd.

[57] ABSTRACT

A guard rail attachment is provided which enables the guard rail for a bed to be moved from an upright position to a lower clearance position to provide access to the mattress. The guard rail attachment includes a plate which is secured to the guard rail. A lower hinge is associated with the plate and includes one element which is secured to the plate and another element which is secured to one of the side rails of the bed. An upper hinge is associated with the plate and includes a locking element which releasably locks the guard rail attachment to the bed frame structure.

10 Claims, 3 Drawing Figures

BUNK BED SIDE RAIL HINGE LOCK

BACKGROUND OF THE INVENTION

The present invention relates generally to bed frame structures, and more particularly to an attchment to the guard rail of a bunk bed which enables the guard rail to be moved from a raised position to a lower clearance position.

The upper berth of a bunk bed is elevated several feet above the floor and poses a potential hazard to a person in that berth if the person were to roll out of the bed while sleeping.

In an attempt to overcome this problem, guard rails have been provided around the periphery of the mattress in the upper berth and the guard rail extends vertically above the height of the mattress. In some instances, the guard rail is only a few inches higher than the mattress, and some accidents still occur from falling over the side of the upper berth.

In other instances, the guard rail extends substantially above the height of the mattress but is permanently secured in a fixed position. As a result, it has been awkward and difficult for persons to tuck sheets and blankets under the upper mattress to make up the upper berth of the bed.

SUMMARY OF THE INVENTION

The present invention overcomes the problems encountered in the prior art by providing an attachment for a guard rail which enables the guard rail to be pivoted relative to the remainder of a bed frame structure which has a pair of side rails and a pair of end rails.

The guard rail attachment of the present invention includes a plate which has an inside major face and an outside major face. The plate is secured to the guard rail with the outside major face of the plate in surface to surface engagement with the guard rail. A hinge which is associated with the plate includes a pair of interleaved elements having a common pivot axis which is generally horizontal and is parallel to one of the side rails. One of the hinge elements is secured to the plate and the other hinge element is secured to the one side rail. A locking element is associated with the plate for releasably locking the plate to the bed frame structure so that the guard rail is in a raised position extending vertically above the height of the mattress when the locking element is locked to the bed frame structure, and the guard rail is movable to a lower clearance position when the locking element is released from the bed frame structure by pivoting the guard rail and plate about the pivot axis of the hinge.

More specifically, the side rails each have a generally horizontal leg for supporting a peripheral portion of the mattress, and a generally horizontal leg. The locking element includes a second hinge which has a pivot axis which is generally horizontal and perpendicular to the axis of one side rail. The second hinge includes a pair of members. One of the hinge members is secured to the plate. The other hinge member has a grippable handle at one end and a locking member at the other end which has an axis in a plane parallel to the vertical leg of the one side rail. The handle is movable to correspondingly move the locking member between the locking position in which the locking member engages the vertical leg of the one side rail to lock the guard rail in the raised position, and a disengaged position in which the locking member is released from the vertical leg for pivoting the guard rail to the clearance position.

DETAILED DESCRIPTION OF THE PREFERRED EMBODIMENT

Figure 1:
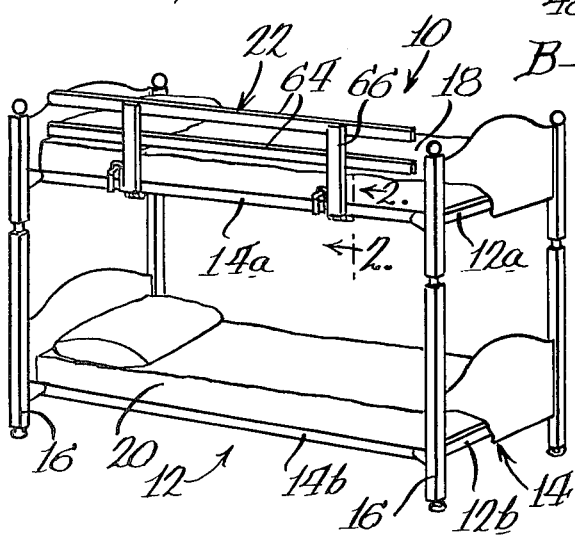
FIG. 1 is a perspective view showing a bunk bed having the guard rail attachment of the present invention incorporated therein, partially broken away to show interior detail.

While this invention is susceptible of embodiment in many different forms, there is shown in the drawing and will herein be described in detail a preferred embodiment of the invention with the understanding that the present disclosure is to be considered as an exemplification of the principles of the invention and is not intended to limit the invention to the embodiment illustrated.

Figure 2:
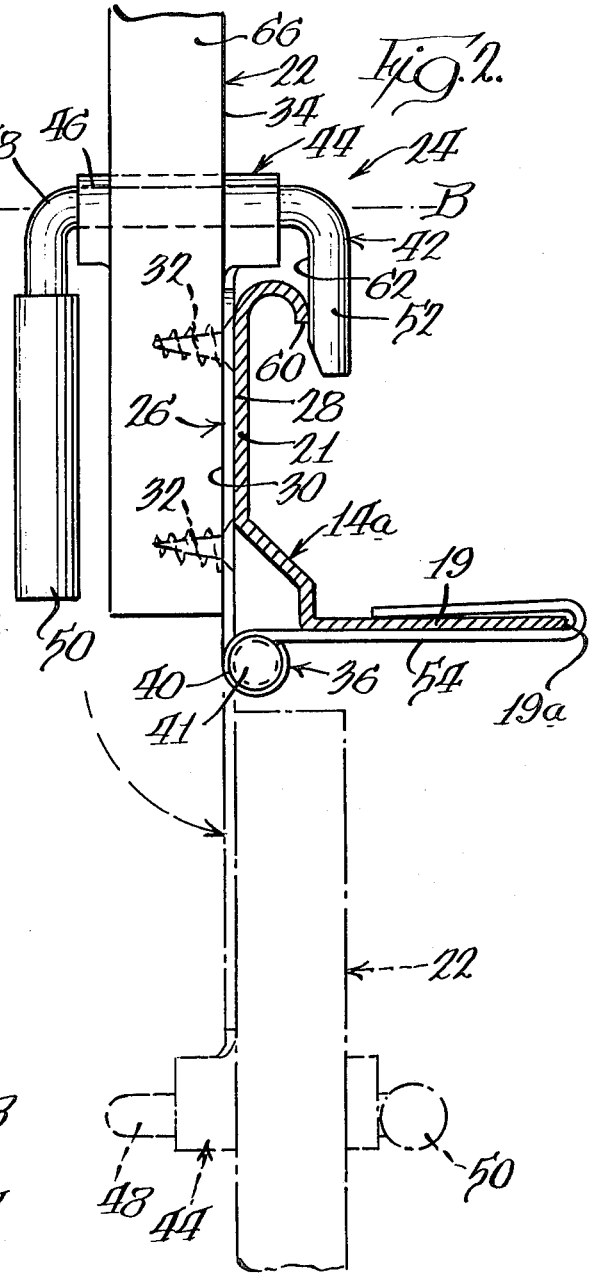
FIG. 2 is an enlarged fragmentary cross-sectional view taken along plane 2—2 of FIG. 1, showing the guard rail and guard rail attachment of the present invention in solid lines and in a lower clearance position in phantom.

FIG. 1 shows a perspective view of the bunk bed generally designated by the reference numeral 10 consisting of two sides 12 defining end sections and two sides 14 defining side sections as well as four vertical posts 16 positioned at the corners of the bed frame. As is conventional in bunk beds, the end sections 12 and side sections 14 extend between and interconnect the vertical corner posts 16 for supporting mattresses on the bunk bed structure. More specifically, the end sections 12 and side sections 14 each include two pairs of generally horizontal, spaced-apart members, namely upper end rails **12*a* and upper side rails 14*a* for supporting the upper mattress 18, and lower end rails 12*b* and lower side rails 14*b* for supporting the lower mattress 20. As shown in FIG. 2, wide rail 14*a* has a horizontal leg 19 which is adapted to receive and support a peripheral portion of the mattress 18, and a vertical leg 21**.

Guard rails 22 are associated with the upper mattress 18 and extend vertically above the height of the mattress to protect a person in the upper berth of the bunk bed. As shown in FIG. 1, a guard rail 22 is attachable to the upper side rails **14*a*. Since one side of the bed usually is positioned adjacent to a wall in a room, only one guard rail 22 might be required for side rails 14*a*. As is also shown in FIG. 1, a headboard and a footboard are associated with the end rails and extend vertically above the height of the mattresses 18 and and 20**, respectively.

In accordance with the present invention, means is provided for pivotally connecting the guard rail 22 to at least one of the end rails **12*a* or side rails 14*a*. In the illustrated embodiment, guard rail 22 is attached to one of the side rails 14*a***.

Figure 3:
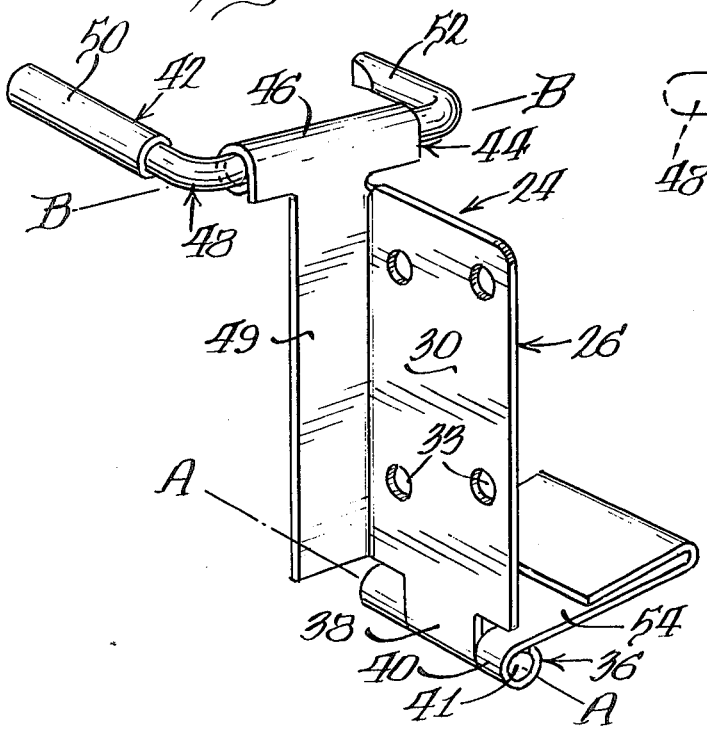
FIG. 3 is a perspective view showing the guard rail attachment of the present invention.

Referring to FIGS. 2 and 3, the connecting means is generally designated by the reference numeral 24 and includes a plate 26 having an inside major face 28 and an outside major face 30. As shown in FIG. 2, the plate 26 is secured to the guard rail 22, as by screws 32 which extend through apertures 33 in the plate, such that the outside major face 30 of the plate is in surface to surface engagement with face 34 of the guard rail 22.

A lower hinge 36 is associated with the plate and includes at least two elements 38 and 40 which have a common axis A—A parallel to the axis of the side rail 14*a*, as seen in FIGS. 2 and 3. One of the elements (e.g., element 38) is secured to the plate 26 as by being integral therewith, and the other hinge element is secured to side rail 14*a*. A pivot pin 41 may be received in a through aperture defined by hinge elements 38 and 40.

The connecting means 24 further includes a locking member 42 which is associated with the plate 26 for releasably locking the plate to the frame structure of the bunk bed. The locking member 42 includes an upper hinge 44 which includes a pair of interleaved members 46 and 48 having a common pivot axis B—B which is generally horizontal and perpendicular to the axis A—A of hinge elements 38 and 40 and is also perpendicular to the axis of side rails 14*a*.

One of the hinge members (e.g., member 46) defines an opening and the other hinge member (e.g., (member 48) defines a pin received in the opening. The first of the hinge members (e.g., member 46) is secured to the plate 26 as by being integral therewith; as shown in FIG. 3, hinge member 46 may be the uppermost portion of a flange 49 which is integral with plate 26 and perpendicular thereto. The second of the hinge members (e.g., member 48) is generally U-shaped. A grippable handle 50 is at one end of hinge member 48 and a locking element 52 is at the other end of hinge member 48. Preferably, both the grippable handle 50 and locking element 52 have axes in planes parallel to the vertical leg 21 of side rail 14*a*. The intermediate portion of hinge member 48 is received in the opening defined by hinge member 46. The opening has a length about equal to the length of the intermediate portion, thereby preventing locking element 52 from moving in the direction of axis B—B. The locking member 42 is positioned such that the locking element 52 is releasably securable to the vertical leg 21 of the side rail 14*a*.

As shown in FIG. 2, the grippable handle 50 is movable to correspondingly move the locking element 52 between a raised, locked position shown in solid lines and a lower, clearance position shown in phantom. In the raised position, the locking element 52 engages the vertical leg 21 to lock the guard rail 22 in the protective position (which is also shown in FIG. 1) in which the guard rail extends vertically above the height of the mattress. By rotating the handle 50 about 90° to a horizontal position, the locking element 52 is released from the vertical leg 21; in this disengaged condition, the guard rail 22 can be pivoted about lower hinge 36 to the lower clearance position shown in phantom in FIG. 2 to provide access to mattress 18.

As stated above, the lower hinge 36 includes a hinge element 40 that is secured to the side rail 14*a*. More particularly, hinge element 40 can include a generally flat plate 54 which is releasably secured to the horizontal leg 19 of the side rail 14*a*. As shown in FIG. 2, the horizontal leg 19 terminates in an inner edge 19*a* and the flat plate 54 is secured to the horizontal leg by being bent about the inner edge of the horizontal leg to form clip means which receives the innermost portion of the horizontal leg 19.

In the illustrated embodiment, the locking member 42 is secured to the vertical leg 21 of side rail 14*a*, as shown in FIG. 2. The upper portion of the vertical leg 21 is bent inwardly and terminates in an inner edge 60. The inside surface 62 of locking element 52 is spaced from the inside major face 28 of the plate 26 by a distance about equal to the width of the J-shaped upper edge of the vertical leg 21. Thus, when the guard rail is in the raised position, the inside surface 62 of the locking element 52 engages the innermost portion of vertical leg 21 which is along inner edge 60 to lock the guard rail in the raised position.

The guard rail 22 preferably includes at least one horizontal rail 64 which extends vertically above the height of the mattress when the guard rail is in the raised position. In the illustrated embodiment, two horizontal rails 64 are provided (FIG. 1). At least two generally vertical secondary rails 66 are generally perpendicular to and secured to each of the horizontal rails 64 and extend from each of the horizontal rails to the side rail 14*a*. A separate connecting means 24 is provided for each secondary rail 66, with one of the plates 26 secured to face 34 of each secondary rail adjacent the bottom end of the secondary rail.

What is claimed is:

1. A rectangular bed frame structure comprising:

vertical posts at the corners of the frame;

interconnecting means extending between said vertical posts for supporting mattress means on said frame;

guard rail means associated with said interconnecting means extending vertically above the height of said mattress means; and means for pivotally connecting said guard rail means to at least one of said interconnecting means, said connecting means comprising a plate having an inside major face and an outside major face, means securing the outside major face of said plate in surface to surface engagement with said guard rail means, hinge means associated with said plate comprising a pair of elements having a common pivot axis parallel to the axis of said one interconnecting means, one of said elements being secured to said plate and the other of said elements being secured to said one interconnecting means, and locking means associated with said plate for releasably locking said plate to said bed frame structure; said guard rail means being in a raised position extending vertically above the height of said mattress means when said locking means is locked to said bed frame structure, said guard rail means being movable to a lower clearance position when said locking means is released from said bed frame structure by pivoting said guard rail means and said plate about said pivot axis;

wherein said one interconnecting means includes a horizontal leg for supporting said mattress means and a vertical leg, said locking means being eagageable with said vertical leg when locked to said bed frame structure; and wherein said hinge means comprises first hinge means and said locking means includes second hinge means comprising a pair of interleaved members having a common pivot axis which is generally horizontal and perpendicular to the axis of said one interconnecting means, one of said members defining an opening and the other of said members defining a pin received in said opening, a first of said members being secured to said plate, the second of said members being generally U-shaped and having grippable handle means at one end and a locking element at the other end which has an axis in a plane parallel to the vertical leg of said one interconnecting means, said handle being movable to correspondingly move said locking element between a locking position in which said locking element engages said vertical leg of said one interconnecting means to lock said guard rail means in said raised position, and a disengaged position in which said locking element is released from said vertical leg for pivoting said guard rail means to said clearance position.

2. A rectangular bed frame structure as defined in claim 1 wherein said other element includes a generally flat plate which is secured to said horizontal leg of said one interconnecting means.

3. A rectangular bed frame structure as defined in claim 1 wherein said horizontal leg terminates in an inner edge, and said flat plate is secured to said horizontal leg by being bent about the inner edge of said horizontal leg and receiving a portion of said horizontal leg.

4. A rectangular bed frame structure as defined in claim 1 wherein the upper portion of said vertical leg is bent inwardly and terminates in an inner edge, and said locking element engages said inner edge to lock said guard rail means in said raised position.

5. A rectangular bed frame structure as defined in claim 1 wherein said guard rail means comprises at least one horizontal rail which extends vertically above the height of said mattress means when in said raised position, and at least two secondary rails perpendicular to and secured to each of said horizontal rails and extending from each of said horizontal rails to said one interconnecting means, and said connecting means includes at least two plates, one of said plates being secured to each of said secondary rails.

6. A guard rail attachment for use with a bed frame structure having a pair of side rails and a pair of end rails, comprising:

a plate having an inside major face and an outside major face, means securing the outside major face of said plate in surface to surface engagement with said guard rail, hinge means associated with said plate comprising a pair of interleaved elements having a common pivot axis parallel one of said side rails, one of said elements being secured to said plate and the other of said elements being secured to said one side rail, and locking means associated with said plate for releasably locking said plate to said bed frame structure;

said guard rail being in a raised position extending vertically above the height of said mattress means when said locking means is locked to said bed frame structure, and said guard rail being movable to a lower clearance position when said locking means is released from said bed frame structure by pivoting said guard rail and said plate about said pivot axis;

wherein said one side rail includes a horizontal leg for supporting said mattress means and a vertical leg, said locking means being engageable with said vertical leg when locked to said bed frame structure;

wherein said hinge means comprises first hinge means and said locking means includes second hinge means comprising a pair of interleaved members having a common pivot axis which is generally horizontal and perpendicular to the axis of said one side rail, one of said members defining an opening and the other of said members defining a pin received in said opening, a first of said members being secured to said plate, the second of said members being generally U-shaped and having grippable handle means at one end and a locking element at the other end which has an axis in a plane parallel to the vertical leg of said one side rail, said handle being movable to correspondingly move said locking element between a locking position in which said locking element engages said vertical leg of said one side rail to lock said guard rail in said raised position, and a disengaged position in which said locking element is released from said vertical leg for pivoting said guard rail to said clearance position.

7. A guard rail attachment as defined in claim 6 wherein said other element includes a generally flat plate which is secured to said horizontal leg of said one side rail.

8. A guard rail attachment as defined in claim 6 wherein said horizontal leg terminates in an inner edge, and said flat plate is secured to said horizontal leg by being bent about the inner edge of said horizontal leg and receiving a portion of said horizontal leg.

9. A guard rail attachment as defined in claim 6 wherein the upper portion of said vertical leg is bent inwardly and terminates in an inner edge, and said locking element engages said inner edge to lock said guard rail in said raised position.

10. A guard rail attachment as defined in claim 6 wherein said guard rail comprises at least one horizontal rail which extends vertically above the height of said mattress means when in said raised position, and at least two secondary rails perpendicular to and secured to each of said horizontal rails and extending from each of said horizontal rails to said one side rail, and said guard rail attachment includes at least two plates, one of said plates being secured to each of said secondary rails.

* * * * *